United States Patent [19]

Larsh

[11] 3,931,781

[45] Jan. 13, 1976

[54] STABILIZER UNIT FOR MARINE VESSELS

[76] Inventor: Everett P. Larsh, 1001 E. Ridge Lane, Miami, Fla. 33157

[22] Filed: Nov. 18, 1974

[21] Appl. No.: 524,634

[52] U.S. Cl. ..... 114/126

[51] Int. Cl.[2] ..... B63B 39/06

[58] Field of Search ..... 114/121, 122, 126, 129, 114/163

[56] References Cited

UNITED STATES PATENTS

| | | | |
|---|---|---|---|
| 1,499,900 | 7/1924 | Zucker | 114/126 |
| 3,377,975 | 4/1968 | Field | 114/126 |
| 3,618,553 | 11/1971 | Ehluss | 114/126 |
| 3,687,100 | 8/1972 | Larsh | 114/126 |

FOREIGN PATENTS OR APPLICATIONS

| | | | |
|---|---|---|---|
| 573,954 | 12/1945 | United Kingdom | 114/126 |
| 1,301,936 | 7/1962 | France | 114/126 |
| 827,908 | 2/1960 | United Kingdom | 114/126 |

*Primary Examiner*—Trygve M. Blix
*Assistant Examiner*—Stuart M. Goldstein
*Attorney, Agent, or Firm*—Jacox & Meckstroth

[57] ABSTRACT

Stabilizer or anti-roll structure for marine vessels. The structure comprises a plurality of fins which are joined together as a unit, and the unit is adapted to be positioned at the side of a vessel below the water line and attached to a rotative or pivotal shaft which extends from the vessel.

7 Claims, 4 Drawing Figures

STABILIZER UNIT FOR MARINE VESSELS

RELATED APPLICATIONS

The subject matter of this application is related to the subject matter of U.S. Pat. Nos. 3,687,100, 3,842,777, and 3,818,959, owned by the Applicant herein.

BACKGROUND OF THE INVENTION

In the past, various types of marine vessel stabilizers or anti-roll devices of the fin type have been created. Fin structure has been employed in which a pair of fins extend from a marine vessel so that one fin is positioned on each side of the vessel and is attached to a rotary shaft for angular movement of the fin. However, in order to provide proper stabilization or anti-roll action in regard to such structure it has been necessary to employ a fin which has considerable area and which extends a considerable distance from the side of the vessel. Thus, the structure having one fin positioned at each side of the vessel is objectionable, particularly in situations in which space requirements are critical. Furthermore, fin members which have large area frequently are damaged by striking objects or by being struck by underwater objects.

It is an object of this invention to provide marine vessel stabilizer or anti-roll structure of the fin type in which the fin structure is capable of effective control of the vessel but in which the fin structure extends a very minimum distance from the vessel at the sides thereof.

It is another object of this invention to provide a stabilizer unit which is capable of more effective anti-roll control than can be obtained with a single fin.

It is another object of this invention to provide such stabilizer or anti-roll structure which can be constructed in any one of many shapes and configurations.

It is another object of this invention to provide such stabilizer or anti-roll structure which may include any suitable number of fin elements.

Another object is to provide such stabilizer or anti-roll structure which can be constructed at relatively low costs and which is long lived.

Other objects and advantages of this invention reside in the construction of parts, the combination thereof, the method of manufacture, and the mode of operation, as will become more apparent from the following description.

SUMMARY OF THE INVENTION

This invention comprises marine vessel stabilizer or anti-roll structure which is adapted to be attached to a rotary shaft which extends laterally from the vessel below the water line. The stabilizer or anti-roll structure includes a unit provided with a plurality of fin elements which are spaced apart and substantially parallel. The plurality of fin elements provides greater surface area and greater control than a single fin element and thus each fin element may be smaller in surface area than the surface area of a single fin to accomplish the stabilizing effects of a single fin. Thus, the fin unit of this invention does not need to extend so far from the marine vessel to which it is joined.

DESCRIPTION OF THE PREFERRED EMBODIMENT

Figure 1:
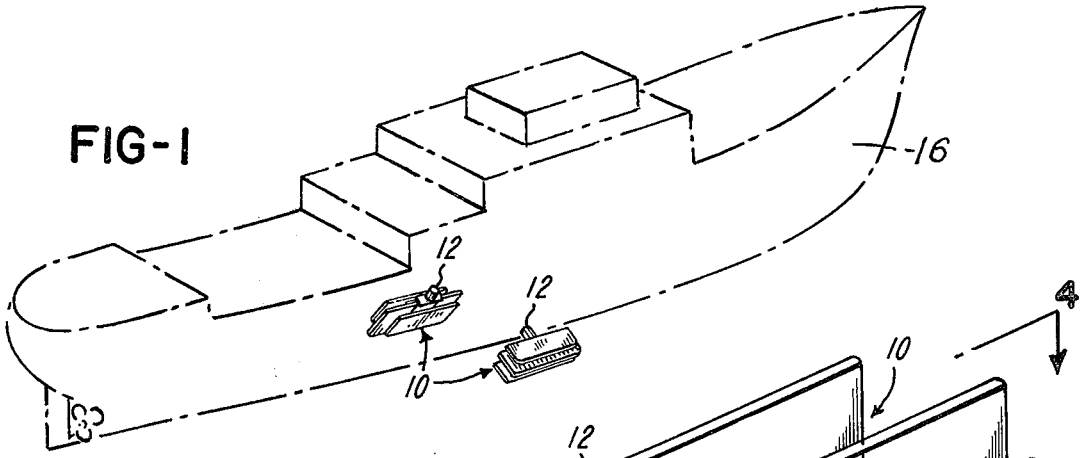
FIG. 1 is a diagrammatic perspective view showing a marine vessel provided with a pair of stabilizer or anti-roll units of this invention.
Figure 2:
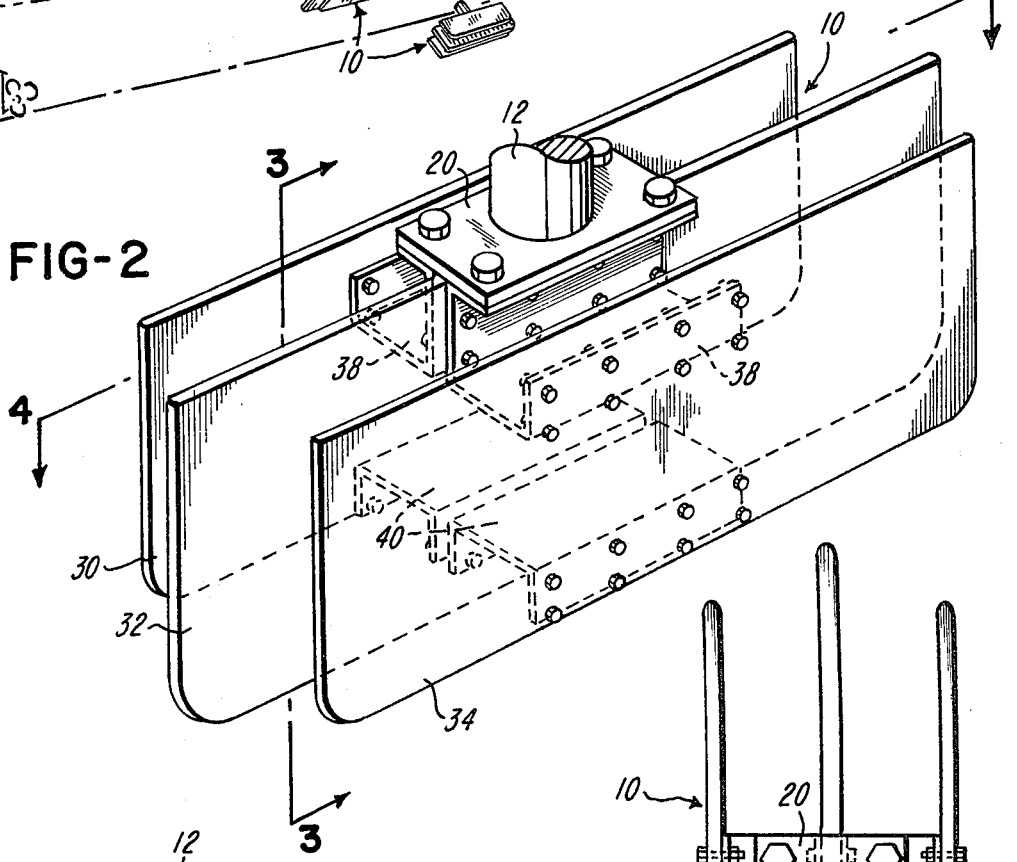
FIG. 2 is a perspective view of a stabilizer or anti-roll unit of this invention, drawn on a much larger scale than FIG. 1.

A stabilizer or anti-roll unit 10 of this invention, as illustrated in FIG. 1, is adapted to be joined to a pivotal or rotative shaft 12 which extends laterally from a marine vessel 16. As shown, a shaft 12 extends from each of the sides of the vessel 16, below the waterline. Each shaft 12 has a portion within the vessel 16 and is joined to suitable motor means (not shown) for pivotal or rotative movement thereof, and the motor means may be joined to any suitable control means (not shown).

Figure 3:
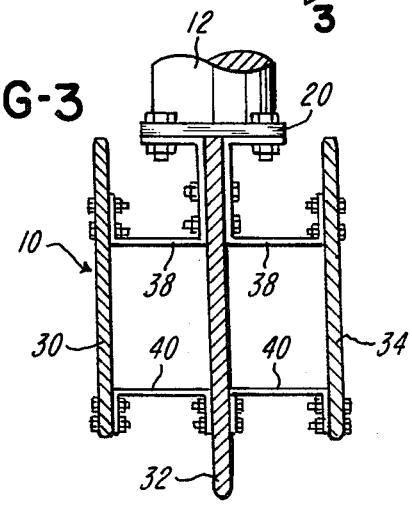
FIG. 3 is a sectional view taken substantially on line 3—3 of FIG. 2.
Figure 4:
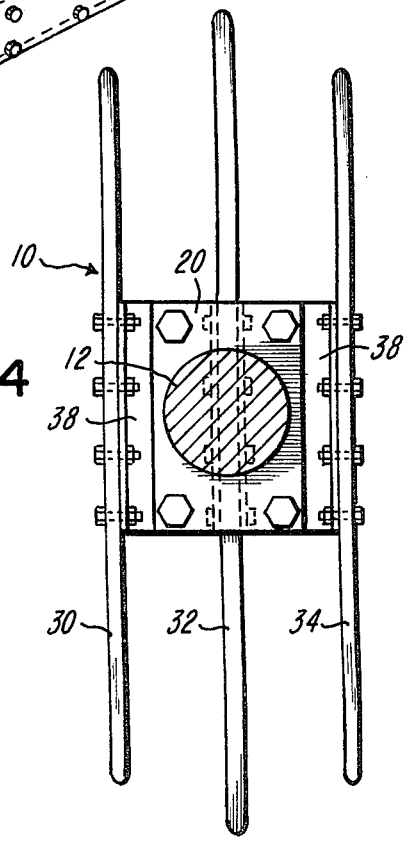
FIG. 4 is a sectional view, taken substantially on line 4—4 of FIG. 2.

Herein, one of the stabilizer units 10 and its respective shaft 12 are discussed. A bracket 20 is secured to the shaft 12 for rotative or pivotal movement therewith. Fin elements 30, 32, and 34 are joined to the bracket 20 in any suitable manner. As best shown in FIG. 3, a pair of generally C-shape connector members 38 are attached to the bracket 20 and to the fin elements 30, 32, and 34. A pair of generally U-shape connector members 40 join together adjacent fin elements 30, 32, and 34. Thus, the fin elements 30, 32, and 34 are attached to the shaft 12 and are maintained in substantially parallel relationship.

To provide stabilization or anti-roll action to the vessel 16 during travel thereof the shafts 12 are adapted to pivotally or rotatively move. Thus, with pivotal movement of the shafts 12, the stabilizer or anti-roll units 10 are angularly moved. With angular movement of the stabilizer or anti-roll units 10, forces are created to urge stable movement of the vessel. Water flows in engagement with the surfaces of the fin elements 30, 32, and 34 and between the fin elements 30 and 32, and between the fin elements 32 and 34. Thus, each stabilizer or anti-roll unit 10 effectively presents a relatively large surface area at any angle determined by the pivotal position of the shaft 12 for creating anti-roll forces upon the vessel 16.

Herein the central fin element 32 is shown as being larger than the fin elements 30 and 34. However, all of the fin elements in a stabilizer or anti-roll unit of this invention may be the same size and surface area, or each of the fin elements may have a size and surface area different from that of any of the other fin elements in the stabilizer or anti-roll unit. Also, any number of fin elements, such as two, four, five, etc. may comprise a stabilizer or anti-roll unit of this invention.

Although the preferred embodiment of the device has been described, it will be understood that within the purview of this invention various changes may be made in the form, details, proportion and arrangement of parts, the combination thereof, and mode of operation, which generally stated consist in a device capable of carrying out the objects set forth, as disclosed and defined in the appended claims.

The invention having thus been described, the following is claimed:

1. Anti-roll structure for a marine vessel of the type having a pivotal shaft extending from the hull thereof, comprising:

a bracket for attachment to the end of the shaft for pivotal movement therewith, a main fin element adjacent the bracket and extending axially from the shaft, a pair of auxiliary fin elements, there being an auxiliary fin element spaced laterally from the main fin element at each side thereof, a pair of generally C-shape connector members attached to the bracket, there being a C-shape connector member at each side of the main fin element attached to the main fin element and to one of the auxiliary fin elements, the fin elements thus being pivotally movable with pivotal movement of the shaft.

2. The anti-roll structure of claim 1 which includes a pair of generally U-shape connector members, there being a U-shape connector member at each side of the main fin element attached to the main fin element and to one of the auxiliary fin elements.

3. An anti-roll stabilizer for a marine vessel having a rotatable shaft with an outer end portion projecting outwardly from the hull of the vessel, comprising:

a plurality of fin elements disposed in substantially parallel spaced relation with each set of adjacent fin elements defining a fluid channel therebetween, means for rigidly connecting said fin elements to maintain said parallel spaced relation and to form a rigid multiple-fin stabilizing unit, and means for rigidly securing generally the center portion of said multiple-fin stabilizing unit to said outer end portion of said shaft with said fins extending substantially parallel to said shaft and to effect rotation of said unit on the axis of said shaft.

4. The stabilizer structure of claim 3 in which there are three fin elements, there being a middle fin element between two other fin elements, the middle fin element having a different surface area from the area of other two fin elements.

5. The stabilizer structure of claim 3 in which one of the fin elements has a larger surface area than any other of the fin elements.

6. An anti-roll stabilizer for a marine vessel having a rotatable shaft with an outer end portion projecting outwardly from the hull of the vessel, comprising:

a plurality of fin elements disposed in substantially parallel spaced relation with each set of adjacent fin elements defining a fluid channel therebetween, said fin elements including a main fin element and a pair of auxiliary fin elements spaced with said main fin element therebetween, means for rigidly connecting said fin elements to maintain said parallel spaced relation and to form a rigid multiple-fin stabilizing unit, and means for rigidly securing generally the center portion of said multiple-fin stabilizing unit to said outer end portion of said shaft with said fins extending substantially parallel to said shaft and to effect rotation of said unit on the axis of said shaft.

7. An anti-roll stabilizer for a marine vessel having a rotatable shaft with an outer end portion projecting outwardly from the hull of the vessel, comprising:

a plurality of fin elements disposed in substantially parallel spaced relation with each set of adjacent fin elements defining a fluid channel therebetween, means for rigidly connecting said fin elements to maintain said parallel spaced relation and to form a rigid multiple-fin stabilizing unit, means for rigidly securing generally the center portion of said multiple-fin stabilizing unit to said outer end portion of said shaft with said fins extending substantially parallel to said shaft and to effect rotation of said unit on the axis of said shaft, and said securing means including a set of bracket members, some of which also form said means for rigidly connecting said fin elements.

* * * * *